US009301040B2

(12) United States Patent
Annunziato et al.

(10) Patent No.: US 9,301,040 B2
(45) Date of Patent: Mar. 29, 2016

(54) PRESSURE EQUALIZATION IN EARPHONES

(71) Applicant: Bose Corporation, Framingham, MA (US)

(72) Inventors: Kevin P. Annunziato, Medway, MA (US); Jason Harlow, Watertown, MA (US); Mihir D. Shetye, Framingham, MA (US); Ryan C. Silvestri, Franklin, MA (US)

(73) Assignee: Bose Corporation, Framingham, MA (US)

( * ) Notice: Subject to any disclaimer, the term of this patent is extended or adjusted under 35 U.S.C. 154(b) by 90 days.

(21) Appl. No.: 14/211,556

(22) Filed: Mar. 14, 2014

(65) Prior Publication Data

US 2015/0264467 A1 Sep. 17, 2015

(51) Int. Cl.
*H04R 1/10* (2006.01)
*H04R 1/28* (2006.01)

(52) U.S. Cl.
CPC ..... *H04R 1/1066* (2013.01); *H04R 1/105* (2013.01); *H04R 1/1016* (2013.01); *H04R 1/1058* (2013.01); *H04R 1/1075* (2013.01); *H04R 1/2826* (2013.01); *H04R 1/2884* (2013.01); *H04R 2201/10* (2013.01); *H04R 2420/07* (2013.01); *H04R 2460/11* (2013.01)

(58) Field of Classification Search
CPC .... H04R 1/1016; H04R 1/105; H04R 1/1066; H04R 1/28–1/2819; H04R 1/2838–1/2849; H04R 1/2869–1/2896; H04R 25/02; H04R 25/45; H04R 25/456; H04R 25/48; H04R 25/60; H04R 25/608; H04R 2201/029; H04R 2201/10; H04R 2460/09; H04R 2460/11
See application file for complete search history.

(56) References Cited

U.S. PATENT DOCUMENTS

| | | | | |
|---|---|---|---|---|
| 1,893,474 | A | 1/1933 | Lieber | |
| 2,538,419 | A | 1/1951 | Huston et al. | |
| 4,058,688 | A * | 11/1977 | Nishimura et al. | 381/372 |
| 4,677,679 | A | 6/1987 | Killion | |
| 4,742,887 | A * | 5/1988 | Yamagishi | 181/129 |

(Continued)

FOREIGN PATENT DOCUMENTS

| | | | |
|---|---|---|---|
| DE | 102009038372 | A1 | 3/2011 |
| EP | 0825796 | A2 | 2/1998 |

(Continued)

OTHER PUBLICATIONS

International Search Report and Written Opinion dated Nov. 13, 2013 for International Application No. PCT/US2013/057508.

(Continued)

*Primary Examiner* — Curtis Kuntz
*Assistant Examiner* — Joshua Kaufman

(57) ABSTRACT

A headphone includes an electro-acoustic transducer dividing an enclosed volume into a front volume and a rear volume, a first port in the housing coupling the front volume to an ear canal of a user, a second port in the housing coupling the front volume to space outside the ear, a third port in the housing coupling the rear volume to space outside the ear, and an ear tip configured to surround the first port and including a flap to seal the ear canal from space outside the ear. The second port has a diameter and a length that provide an acoustic mass with an acoustic impedance with a high reactive component and a low resistive component, reducing the occlusion effect that otherwise results from sealing the ear.

25 Claims, 7 Drawing Sheets

(56) References Cited

U.S. PATENT DOCUMENTS

| | | | | | |
|---|---|---|---|---|---|
| 4,870,688 | A | | 9/1989 | Voroba et al. | |
| 4,878,560 | A | | 11/1989 | Scott | |
| 4,880,076 | A | | 11/1989 | Ahlberg et al. | |
| 4,917,504 | A | | 4/1990 | Scott et al. | |
| 4,987,597 | A | * | 1/1991 | Haertl | 381/325 |
| 5,327,507 | A | * | 7/1994 | Suzuki | 381/370 |
| 5,712,453 | A | | 1/1998 | Bungardt et al. | |
| 5,761,298 | A | | 6/1998 | Davis et al. | |
| 5,781,638 | A | * | 7/1998 | Hosaka et al. | 381/322 |
| 5,887,070 | A | * | 3/1999 | Iseberg et al. | 381/380 |
| 5,949,896 | A | * | 9/1999 | Nageno et al. | 381/328 |
| 5,953,414 | A | * | 9/1999 | Abraham et al. | 379/433.02 |
| 6,021,195 | A | | 2/2000 | Brawne et al. | |
| 6,134,336 | A | | 10/2000 | Clark | |
| RE37,398 | E | * | 10/2001 | Nageno | 381/371 |
| 6,320,960 | B1 | | 11/2001 | Lathrop, III et al. | |
| 6,412,593 | B1 | * | 7/2002 | Jones | 181/129 |
| D478,991 | S | | 8/2003 | Dyer et al. | |
| RE38,351 | E | | 12/2003 | Iseberg et al. | |
| 6,688,421 | B2 | | 2/2004 | Dyer et al. | |
| 6,735,316 | B1 | * | 5/2004 | Wurtz | 381/74 |
| 6,738,487 | B1 | * | 5/2004 | Nageno et al. | 381/322 |
| 6,831,984 | B2 | * | 12/2004 | Sapiejewski | 381/71.6 |
| 6,922,476 | B2 | | 7/2005 | Nassimi | |
| 7,916,888 | B2 | * | 3/2011 | Sapiejewski et al. | 381/382 |
| 8,355,522 | B2 | | 1/2013 | Annunziato et al. | |
| 8,526,651 | B2 | * | 9/2013 | Lafort et al. | 381/328 |
| 8,594,351 | B2 | * | 11/2013 | Harlow et al. | 381/309 |
| 8,670,586 | B1 | * | 3/2014 | Boyle et al. | 381/370 |
| 2001/0043707 | A1 | | 11/2001 | Leedom | |
| 2003/0039375 | A1 | * | 2/2003 | Grell et al. | 381/370 |
| 2003/0152244 | A1 | | 8/2003 | Dobras et al. | |
| 2004/0042625 | A1 | | 3/2004 | Brown | |
| 2004/0202343 | A1 | | 10/2004 | Rye et al. | |
| 2005/0147269 | A1 | | 7/2005 | Oliveira et al. | |
| 2008/0002835 | A1 | * | 1/2008 | Sapiejewski et al. | 381/71.6 |
| 2008/0226113 | A1 | * | 9/2008 | Kuhtz et al. | 381/375 |
| 2011/0058704 | A1 | * | 3/2011 | Harlow et al. | 381/380 |
| 2012/0039500 | A1 | * | 2/2012 | Silvestri et al. | 381/380 |
| 2012/0039501 | A1 | * | 2/2012 | Silvestri et al. | 381/380 |
| 2012/0160543 | A1 | | 6/2012 | Nakanishi et al. | |
| 2012/0163649 | A1 | * | 6/2012 | Haapapuro et al. | 381/380 |
| 2012/0217087 | A1 | * | 8/2012 | Ambrose et al. | 181/130 |
| 2012/0269375 | A1 | * | 10/2012 | Tan et al. | 381/380 |
| 2013/0272530 | A1 | * | 10/2013 | Gauger, Jr. | 381/59 |
| 2013/0294635 | A1 | * | 11/2013 | Matsuo et al. | 381/380 |
| 2013/0315410 | A1 | * | 11/2013 | Annunziato et al. | 381/71.6 |
| 2013/0315412 | A1 | * | 11/2013 | Annunziato et al. | 381/71.6 |
| 2014/0294222 | A1 | * | 10/2014 | Sapiejewski et al. | 381/371 |
| 2014/0363040 | A1 | * | 12/2014 | Silvestri et al. | 381/380 |

FOREIGN PATENT DOCUMENTS

| | | | |
|---|---|---|---|
| EP | 1058479 | A2 | 12/2000 |
| EP | 1809069 | A1 | 7/2007 |
| EP | 1874080 | A2 | 1/2008 |
| GB | 2408405 | A | 5/2005 |
| JP | 07-115695 | A | 5/1995 |
| JP | 07-170591 | A | 7/1995 |
| JP | 08-172691 | A | 7/1996 |
| JP | 10-066181 | A | 3/1998 |
| JP | 11-308685 | A | 11/1999 |
| WO | 9931935 | A1 | 6/1999 |
| WO | 0124579 | | 4/2001 |
| WO | 03069951 | A1 | 8/2003 |
| WO | 2007031340 | A2 | 3/2007 |
| WO | 2007089845 | A2 | 8/2007 |
| WO | 2011015236 | A1 | 2/2011 |
| WO | 2014039384 | A1 | 3/2014 |

OTHER PUBLICATIONS http://www.plantronics.com/media/media_resources/literature/user_guides/discovery640_ug_an_e.pdf;jsessionid=XIFCOZVIKEJBOCQBGNUCFFAKAEZWSIVO, Plantronics Discovery 640 User Guide Printed Jun. 2005, pp. 1-18.

International Search Report and Written Opinion dated Jun. 18, 2008 from International Application No. PCT/US2007/088805.

International Report on Patentability dated Jul. 9, 2009 for PCT/US2007/088805.

Office Action dated Dec. 21, 2009 for EP 07111157.9-1224.

EP Search Report dated Dec. 10, 2008 for EP Appl. No. 07111157.9-1224/1874080.

International Search Report and Written Opinion dated Feb. 6, 2012 for PCT/US2011/047728.

Japan Office Action dated Feb. 23, 2012 for application No. 2007-172828.

Chinese Office Action dated Mar. 30, 2012 for Application No. 200710126963.6.

http://www.sonystyle.com/isbinIINTERSHOP.enfinity/eCS/Store/en/-/USD/SY_DisplayProductInformationStartCategoryName=pa_Headphones-FontopiaEarbud&ProductSKU=MDRED21LP&TabName=specs&var2=, Sony MDR ED21LP, copyright 2006.

http://emedia.leeward.hawaii.edu/Frary/sony_mdr-nc1 0_review.htm, SonyMDR-NC10 Noise Canceling Stereo Headphones, Jun. 18, 2002—updated Jun. 27, 2003.

http://www.plantronics.com/media/media_resources/literature/cordless_mobile/discovery640_en.pdf;jsessionid=XIFCOZVIKEJBOCQBGNUCFFAKAEZWSIVO, Plantronics Discovery 640 Bluetooth Headset, Jul. 2005.

http://www.shure.com/PersonalAudio/Products/Earphones/ESeries/us_pa_E500_pth_content, E500PTH Sound Isolating Earphones, Triple Hi-Definition Drivers, Jun. 26, 2006.

International Search Report and Written Opinion dated May 28, 2015 for PCT/US2015/020331.

* cited by examiner

PRESSURE EQUALIZATION IN EARPHONES

BACKGROUND

This disclosure relates to pressure equalization in earphones.

Audio headphones, and in particular, in-ear earphones meant to be seated at least partially in a user's ear canal or ear canal entrance, sometimes have a number of openings, or ports, coupling the volumes within the earphones to the ear canal, to each other, or to free space. As shown in FIG. 1, a typical earphone 10 has a housing 12 defining a front cavity 14 and a rear cavity 16, separated within the body by a electroacoustic transducer, or driver, 18. A main output port 20 couples the front cavity to the ear canal so that the user can hear sound generated by the driver 18. Rear ports 22 and 24 couple the rear cavity to free space to control the acoustic properties of the back cavity and their effect on the audio output or response through the output port 20, as described in U.S. Pat. No. 7,916,888, the entire contents of which are incorporated here by reference. A front port 26 similarly controls the acoustic properties of the front cavity, as described in U.S. Pat. No. 8,594,351, the entire contents of which are incorporated here by reference. The front port 26 also serves as a pressure equalization (PEQ) port because it couples the front cavity to free space. A PEQ port serves to relieve pressure created in the front cavity when the earphone is inserted into the ear. An ear tip 28 serves as an ergonomic interface between the housing 12 and the ear.

SUMMARY

In general, in one aspect, a headphone includes a housing defining an enclosed volume, an electro-acoustic transducer dividing the enclosed volume into a front volume and a rear volume, a first port in the housing arranged to couple the front volume to an ear canal of a user when the headphone is worn, a second port in the housing arranged to couple the front volume to space outside the ear of the user when the headphone is worn, a third port in the housing arranged to couple the rear volume to space outside the ear of the user when the headphone is worn, and an ear tip configured to surround the first port and including a flap to seal the ear canal from space outside the ear when the headphone is worn. The second port has a diameter and a length that provide an acoustic mass with an acoustic impedance with a high reactive component and a low resistive component.

Implementations may include one or more of the following, in any combination. The second port may have a diameter and a length that provide the second port with a low acoustic impedance at low frequencies and a high acoustic impedance at high frequencies. The housing may include an extended tab for retaining the ear tip, and the second port may include an exit from the housing positioned next to the extended tab, with the extended tab between the first port and the second port exit. The ear tip may include a void positioned to surround the second port exit, the ear tip protecting the second port exit from blockage. The void may not impart additional acoustic impedance to the second port. The ear tip may be formed from materials having at least two different hardnesses, the portion of the ear tip defining the void being of a greater hardness than the portion of the ear tip forming the seal. The transducer may include a diaphragm that is generally characterized by a fist plane, is radially symmetric along a first axis perpendicular to the plane, and is bounded by an outer edge, the first port extending from an entrance into the front volume near the outer edge of the transducer, and the second port extending from an entrance into the front volume, the second port entrance being located along a line connecting the first axis to the first port entrance. The second port entrance may be located facing the diaphragm, between the first port and the first axis.

The first port may have a lower characteristic acoustic impedance than the second port. The second port may have a characteristic acoustic impedance of at least $6.8\times10^6$ at 20 Hz and at least $3.1\times10^7$ at 3 kHz. The third port may have a characteristic acoustic impedance of at least $8.0\times10^6$ at 20 Hz and at least $3.1\times10^8$ at 3 kHz the second port may have a characteristic acoustic impedance of at least $6.8\times10^6$ at 20 Hz and at least $3.1\times10^7$ at 3 kHz. A fourth port in the housing may be arranged to couple the front volume to space outside the ear of a user when the headphone is worn, the fourth port having a diameter and a length that provide the fourth port with a high acoustic impedance with a large resistive component and a low reactive component. The fourth port may have a characteristic acoustic impedance of at least $8.3\times10^7$ kg/m$^4$ at 3 kHz.

In general, in one aspect, a headphone includes a housing defining an enclosed volume, an electro-acoustic transducer dividing the enclosed volume into a front volume and a rear volume, a first port in the housing arranged to couple the front volume to an ear canal of a user when the headphone is worn, a second port in the housing arranged to couple the front volume to space outside the ear of the user with a characteristic acoustic impedance of at least $6.8\times10^6$ at 20 Hz and at least $3.1\times10^7$ at 3 kHz when the headphone is worn, a third port in the housing arranged to couple the rear volume to space outside the ear of the user with a characteristic acoustic impedance of at least $8.0\times10^6$ at 20 Hz and at least $3.1\times10^8$ at 3 kHz when the headphone is worn, and an ear tip configured to surround the first port and form a seal between the housing and the ear canal when the headphone is worn.

In general, in one aspect, a headphone includes an ear tip configured to seal the headphone to the ear canal to form an enclosed volume including the ear canal and a front cavity of the headphone, a front reactive port coupling the otherwise-sealed front cavity to space outside the headphone, to provide a consistent response across the audible spectrum, and a rear reactive port and a rear resistive port coupling a back cavity to space outside the headphone in parallel, to provide a high level of output for a given input signal level in combination with the seal.

Implementations may include one or more of the following, in any combination. The headphone may be coupled to the ear canal through a characteristic acoustic impedance of less than $6.8\times10^6$ at 20 Hz and less than $3.1\times10^7$ at 3 kHz. The front reactive port may have a characteristic acoustic impedance of at least $6.8\times10^6$ at 20 Hz and at least $3.1\times10^7$ at 3 kHz the rear reactive port may have a characteristic acoustic impedance of at least $8.0\times10^6$ at 20 Hz and at least $3.1\times10^8$ at 3 kHz.

Advantages include providing a consistent response across the audible spectrum and reduction of the occlusion effect caused by sealing the ear canal.

All examples and features mentioned above can be combined in any technically possible way. Other features and advantages will be apparent from the description and the claims.

DESCRIPTION

Headphones in general, and in-ear headphones in particular, can be broadly divided into two categories with regard to how well they seal to the ear. Isolating headphones are intended to create a sealed front cavity coupling the driver to the ear canal, preventing air flow (and sound pressure leakage) between the ear canal and the environment. Open headphones are intended to not create such a seal, so that air and therefore sound can flow between the environment and the ear canal. In many cases, the choice between isolating and open is made to balance such factors as fidelity, sensitivity, isolation, and comfort. Of course, controlling any of these factors also requires proper configuration of the headphone acoustics. Open headphones tend to be more susceptible to interference from outside noises, while isolating headphones tend to be less comfortable.

Figure 1:
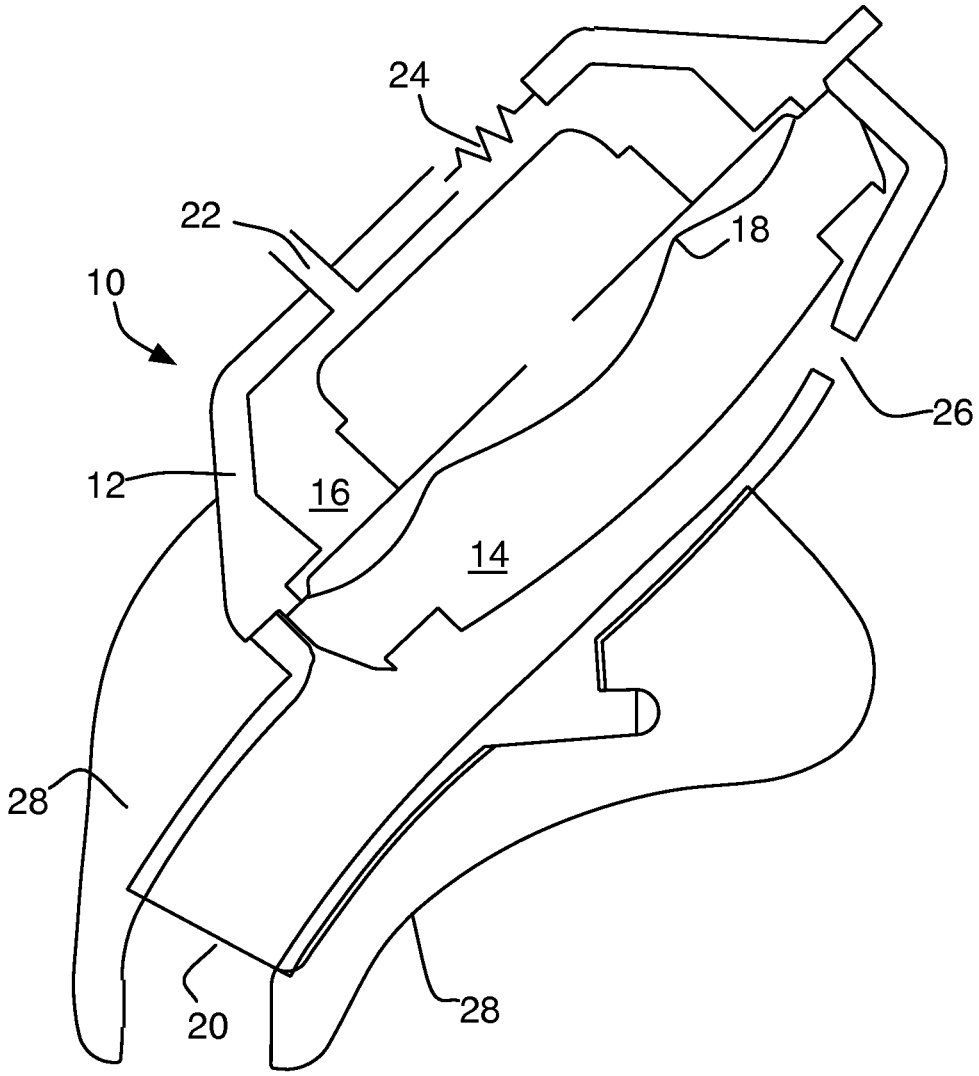
Fig. 1 (prior art)
FIGS. 1, 2, 8, and 10 show cross-sectional views of earphones.

One of the reasons isolating headphones tend to be less comfortable than other types, beyond the simple fact that they put more pressure on the flesh of the ear, is that they cause what is called the occlusion effect, the distortion of the user's perception of his own voice when his ears are plugged. When a user's ear is blocked, whether by earphones, earplugs, or fingers, high-frequency components of the user's voice travelling through the air from mouth to ear are attenuated. At the same time, low-frequency components of the voice travel through the head and directly into the ear canal through the side walls of the ear canal, and are amplified by the acoustic effects of the sealed ear canal relative to how loud they are when the ear is open. These sounds are not just present while the high-frequency sounds are absent, but are actually amplified as a result of being trapped inside the ear canal. The total effect makes the user's voice sound deeper and unnatural, but only to himself. Even when not speaking, sounds such as blood flow and jaw movement are also amplified by the sealed ear canal, causing a stuffed-up sensation independent of the physical presence of whatever is plugging the ear. Earphones that seal the ear canal can also impact the user's situational awareness, that is, his perception of environmental sounds. Sometimes this is desired, but other times it is not. PEQ ports like that shown in FIG. 1 can reduce the occlusion effect, by relieving some of the pressure in the ear canal, but they generally also reduce low frequency output and isolation, taking away some of the advantage intended to be gained by using an isolating earphone in the first place.

Figure 2:
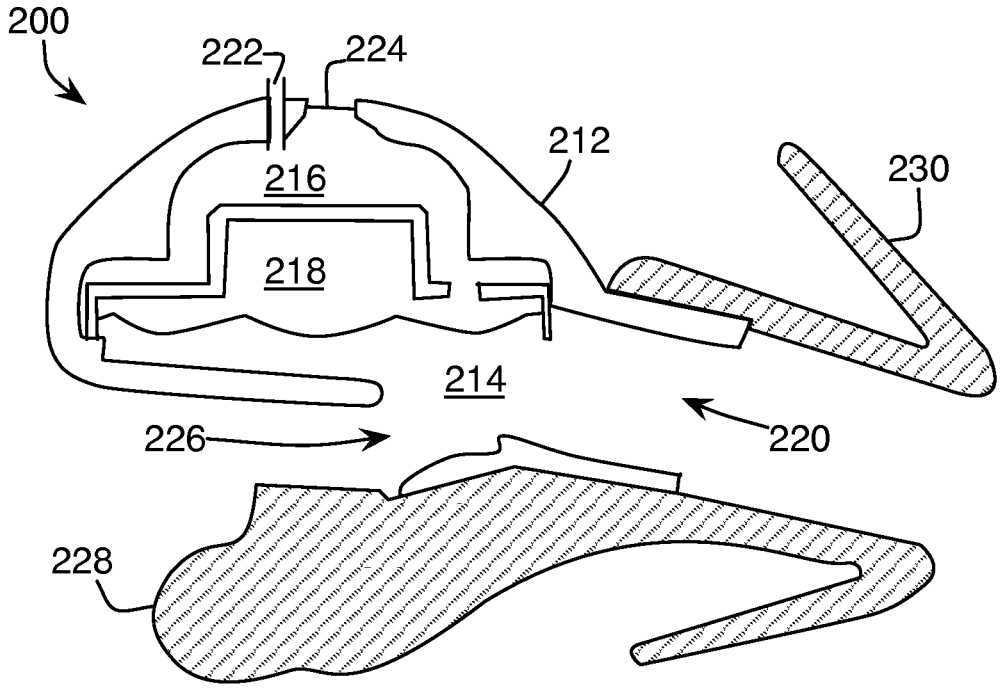
Figure 3:
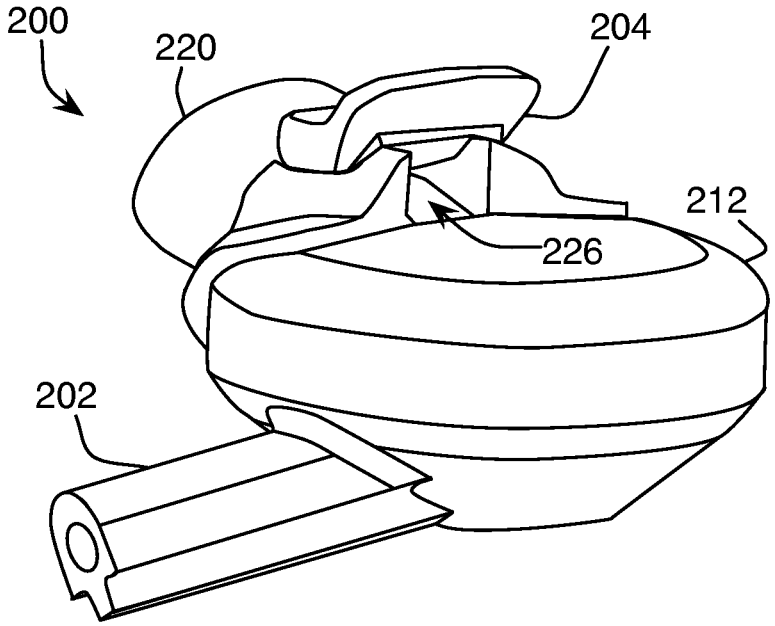
FIGS. 3, 4, and 11 show isometric views of the earphone of FIG. 2.
Figure 4:
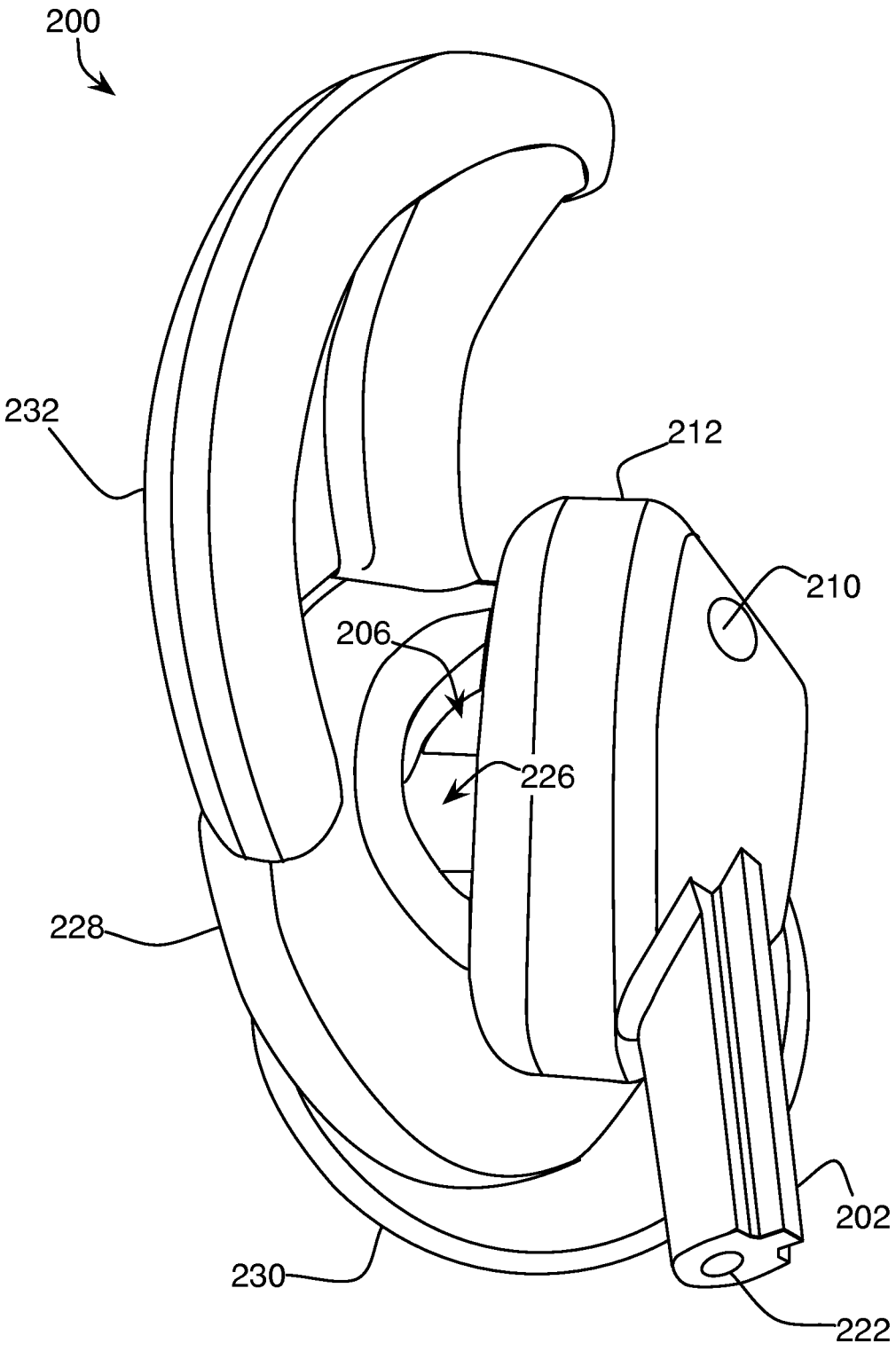

As described below, PEQ ports and rear cavity ports in an earphone that seals to the ear canal are configured in such a way that the occlusion effect is minimized and situational awareness is improved, without losing the improved sensitivity and subsequent control over response characteristics that is provided by sealing the earphone to the ear canal. The sealing ear tip also provides a consistent low-frequency acoustic response across various fits. As shown in FIGS. 2 and 4, such a headphone 200 has a sealing flange 230 extending from the ear tip 228. FIG. 3 shows the headphone 200 with the ear tip removed. The flange contacts the edge of the transition between the user's ear canal and concha, to seal the ear canal without protruding deeply into it, as described in U.S. Patent publication 2013/230204, the contents of which are incorporated here by reference. In combination with this, a PEQ port 226 coupling the front cavity 214 to space outside the ear is configured to be reactive, that is, the port is dimensioned such that the air in it behaves as an acoustic mass, providing the port with a low acoustic impedance at low frequencies, and a higher acoustic impedance at high frequencies. Rear ports 222 and 224 couple the rear cavity 216 to space outside the ear, and provide a reactive and resistive impedance, respectively, further tuning the response of the headphone. As in FIG. 1, the housing 212 defines the front and rear cavities, separated by the driver 218. The nozzle 220 connects the front cavity to the ear canal.

FIGS. 3 and 4 show external views of the same earphone, with the ear tip 228 removed for clarity in FIG. 3. The housing 212 includes an extension 202 containing the reactive port 222. A tab 204 (FIG. 3) retains the ear tip 228 (FIG. 4) when it is installed. In this example, the PEQ port 226 exits the housing under the retaining tab 204. This has the advantage of protecting the PEQ port from being blocked when the earphone is seated in the ear.

As shown in FIG. 4, a gap 206 in the shaped of the ear tip surrounds the PEQ port and further protects the port from being blocked. FIG. 4 also shows an optional positioning and retaining member 232 that extends from the ear tip 228 and seats in the pinna of the ear, to help position and retain the earphone, as described in U.S. Pat. No. 8,249,287, the contents of which are incorporated here by reference. Other options for the construction and packaging of the back cavity ports are described in U.S. patent application Ser. No. 13/606,149 (now U.S. Pat. No. 8,670,586), the contents of which are incorporated here by reference. A wire exit 210 allows wire leads from the driver inside the housing 212 to reach either a cable, in a wired headset, or integrated electronics, in a wireless or otherwise active headset.

Figure 5:
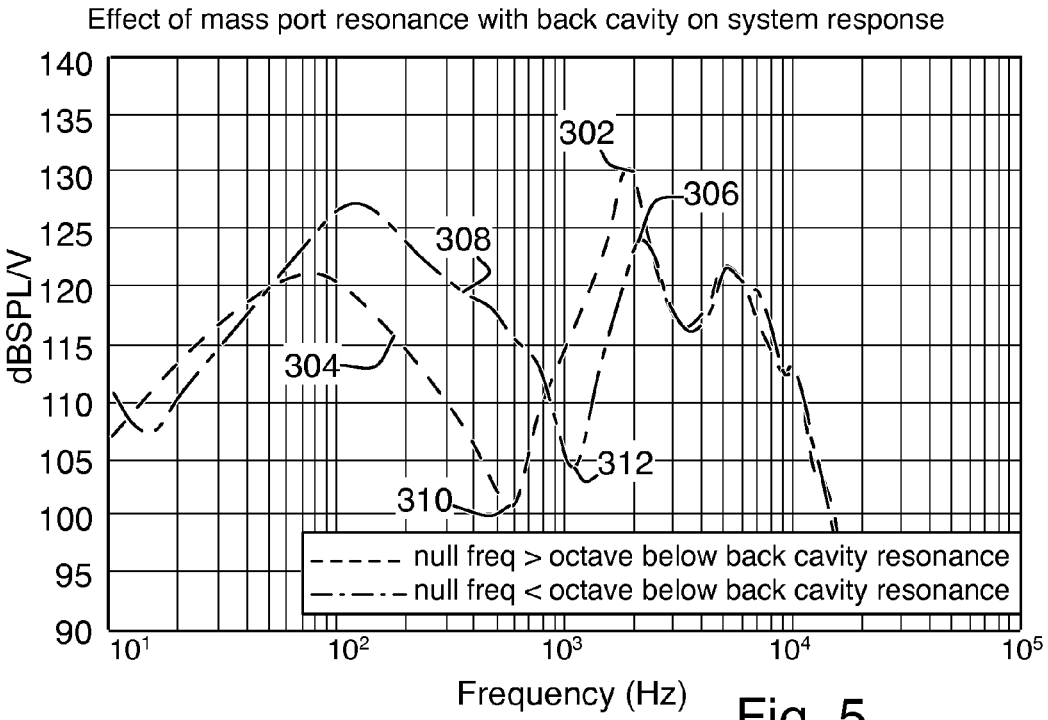
FIGS. 5, 6, and 7 show graphs of earphone response.

FIG. 5 shows two potential response curves for an earphone like that shown in FIG. 2, and in particular, it shows the effect of a reactive back-cavity port 222 that resonates with the back cavity volume 216. The front and back cavities each enclose a volume of air, and therefore each have an acoustic compliance. The driver 218 has a moving mass and an acoustic compliance, which is also measured in units of volume, i.e., $cm^3$, representing the volume of air having an equivalent acoustic compliance. The compliance of the back cavity and the mass of the driver create a resonance in the frequency response, which can be seen in peaks 302 on curve 304 and 306 on curve 308 in FIG. 5. For a typical earphone with a 0.15 $cm^3$ back cavity and a driver with a compliance of 20 to 50 $cm^3$ and a moving mass of 2.5 to 20 mg, the resonance is between 1 and 3 kHz. The reactive port 222 in the back cavity also has an acoustic mass (hence it is sometimes called a mass port), and this mass resonates with the back cavity compliance to create a null in the response, seen in troughs 310 on curve 304 and 312 in curve 308. In some examples, it is desirable that the mass port null be at least an octave below the driver peak. Doing this allows the resistance of the resistive port 224 to damp the response, i.e., lower the peaks, without lowering the response below where it retains enough sensitivity to be effectively equalized.

Figure 6:
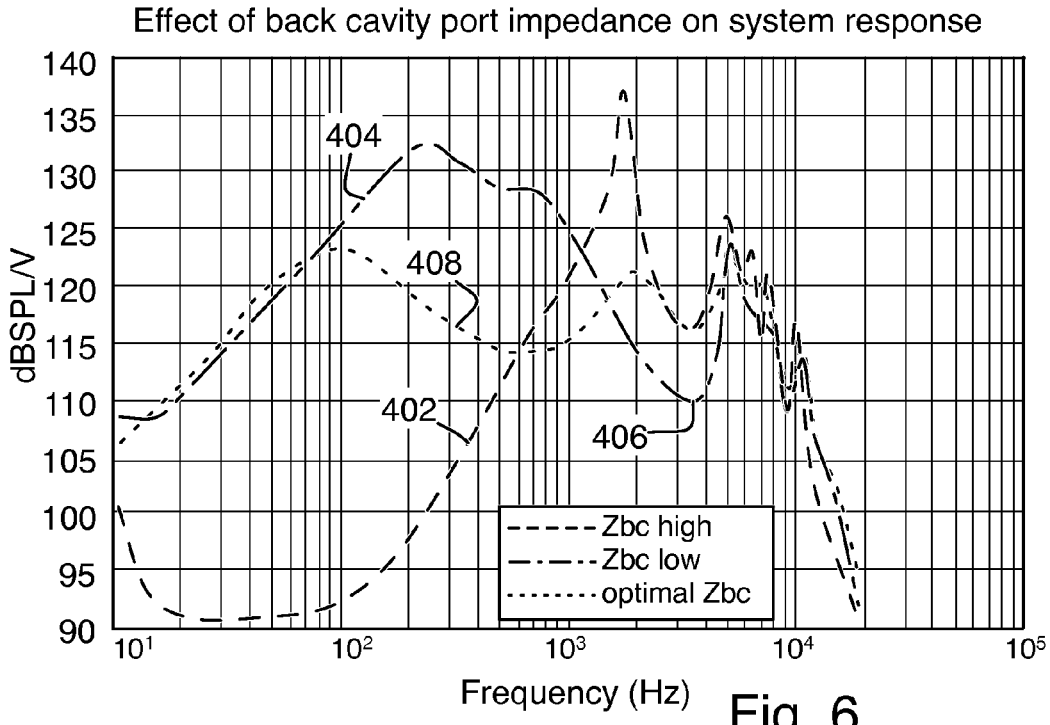
Figure 7:
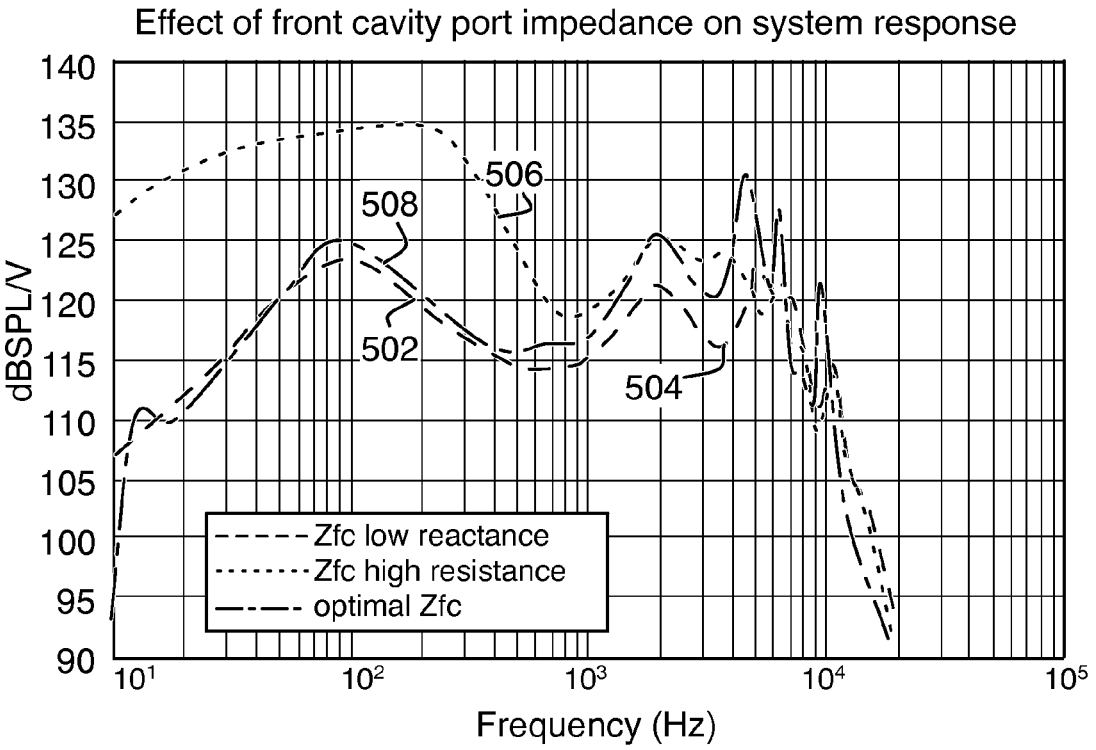

In addition to resonances between the different components causing peaks and nulls, the acoustic impedance of the ports also affects the response. FIG. 6 shows the range of effect that the combined impedance of the back cavity ports has on the total response of the earphone. As curve 402 shows, if the back cavity port impedance Zbc is too high, there is little to no output in lower frequencies. On the other hand, curve 404 shows that if the Zbc is too low, while low frequency response is maintained, mid-frequency response can dip too low, as shown by the trough 406 around 4 to 5 kHz. Such a low dip can prevent the earphone from having enough sensitivity at that range to be equalized to a desirable response. Curve 408 shows a more optimized response, where the impedance of the back cavity ports is balanced to give up some of the higher response between 200 Hz and 1 kHz, from the low-impedance curve 404, and recover the response between 1.5 kHz and 5 kHz, so that the total curve remains above about 115 dBSPL from 30 Hz and up.

Providing a front cavity PEQ having a low acoustic resistance can improve the occlusion effect and situational awareness, as it effectively un-seals the front cavity from the ear canal, but at the expense of output. The midband output can be preserved by maintaining a high reactance in the PEQ port, preserving its impedance while allowing the low resistance needed to avoid occlusion. FIG. 2 shows the response for several variations in front cavity PEQ impedance Zfc. Curve 502 shows the response with a low reactance in Zfc. The overall response is high enough in the middle-low frequencies, but dips too low to be electronically compensated at both the low and high end, in particular at trough 504 at 3 to 4 kHz. Curve 506 shows the response with a high resistance in Zfc—this raises the response in the low end too high, making the occlusion effect unpleasant. Curve 508 shows the response with an optimized Zfc, where a balance of higher reactance and lower resistance provides a response that is high enough across a significant frequency range that sensitivity can be traded for fidelity through equalization. As mentioned in regard to FIG. 2, this optimization, a PEQ port with high reactance and low resistance, can be achieved by providing a port that has a larger cross sectional area, lowering its acoustic resistance, combined with enough length to contain a reactive acoustic mass of air. In some examples, the port is sized to provide a characteristic acoustic impedance that has a resistive value of at least $6.83\times10^6$ kg/m$^4$ at 20 Hz, and a reactive value of $30.10\times10^7$ at 3 kHz, when used with a back cavity mass port having a characteristic acoustic impedance of $8.00\times10^6$ at 20 Hz and $3.10\times10^8$ at 3 kHz. The impedances of the PEQ port at both frequencies could be increased by up to 3 dB without affecting occlusion significantly. Note that the resistive component of the PEQ port is not eliminated completely—the remaining acoustic resistance at low frequency preserves low-frequency output as it shifts the roll-off from second order (if there we no resistance) to first-order. Although this does preserve some occlusion effect, the human voice is not significant in this band, while music does tend to have significant energy.

Figure 8:
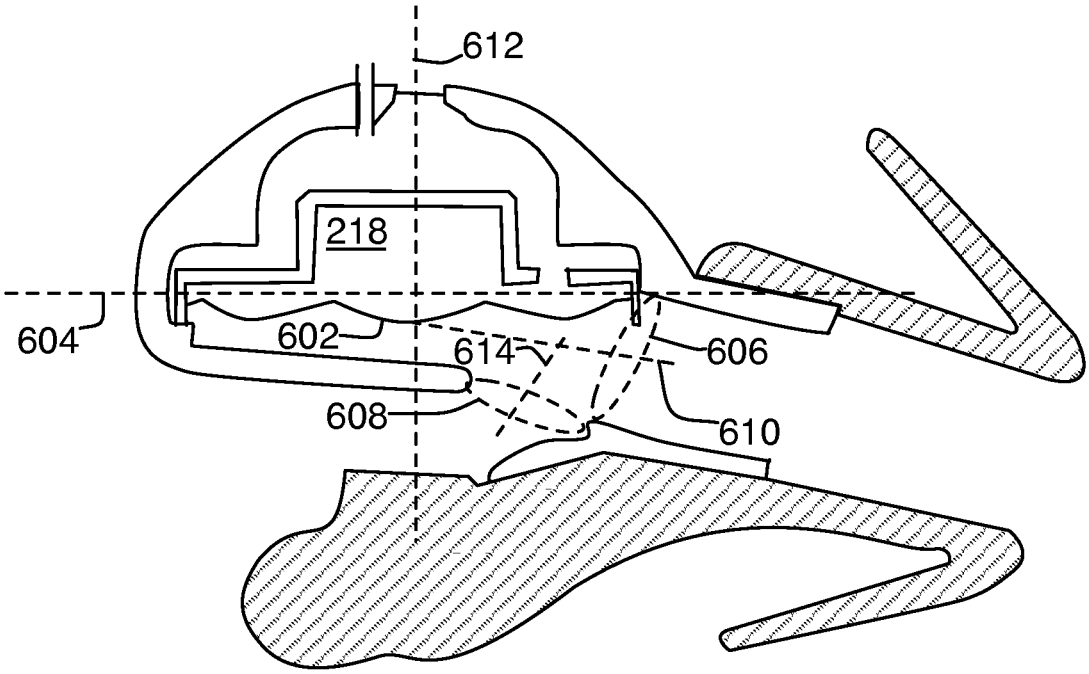
Figure 9:
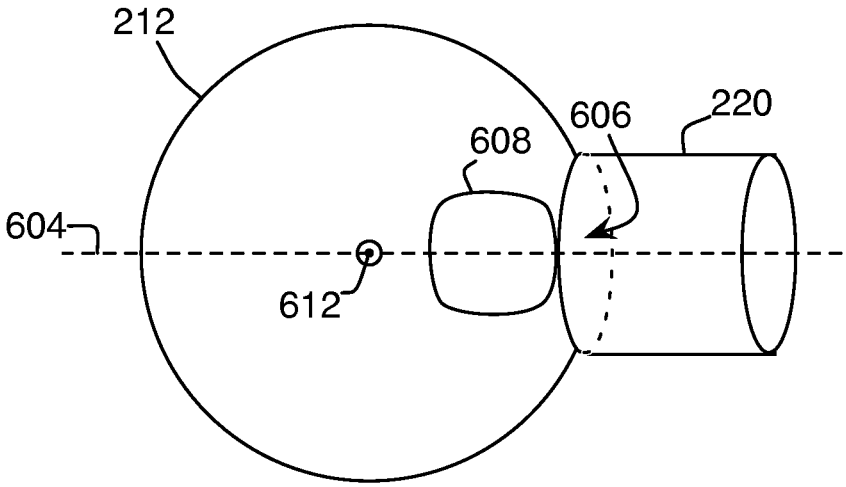
FIG. 9 shows a schematic plan view of the earphone of FIG. 2.

In addition to its impedance, the location of the PEQ port is also controlled to improve headphone performance. Positioning the PEQ port behind the retaining tab, as described above, happens to position the port entrance (the end of the port inside the front cavity) next to the entrance to the nozzle 220, which creates a symmetric loading on the driver 218. This avoids introducing undesirable features or resonances in the acoustic response caused by asymmetric loading. In some examples, as shown in FIGS. 8 and 9, the transducer diaphragm 602, is generally planar, characterized by a plane 604. The nozzle has an entrance 606 at the edge of the diaphragm, though it is not necessarily in the plane 604 of the diaphragm. The PEQ port has an entrance 608 to the front cavity that is positioned to align with a radial line 610 from the centerline of the transducer (line 612) to the entrance of the nozzle. That is, the line 612 corresponds to an axis around which the diaphragm is radially symmetric, the line 610 intersects the line 612 and passes through the entrance 606 of the nozzle, and a line 614 intersects the line 610 and passes through the entrance 608 of the PEQ port.

Figure 10:
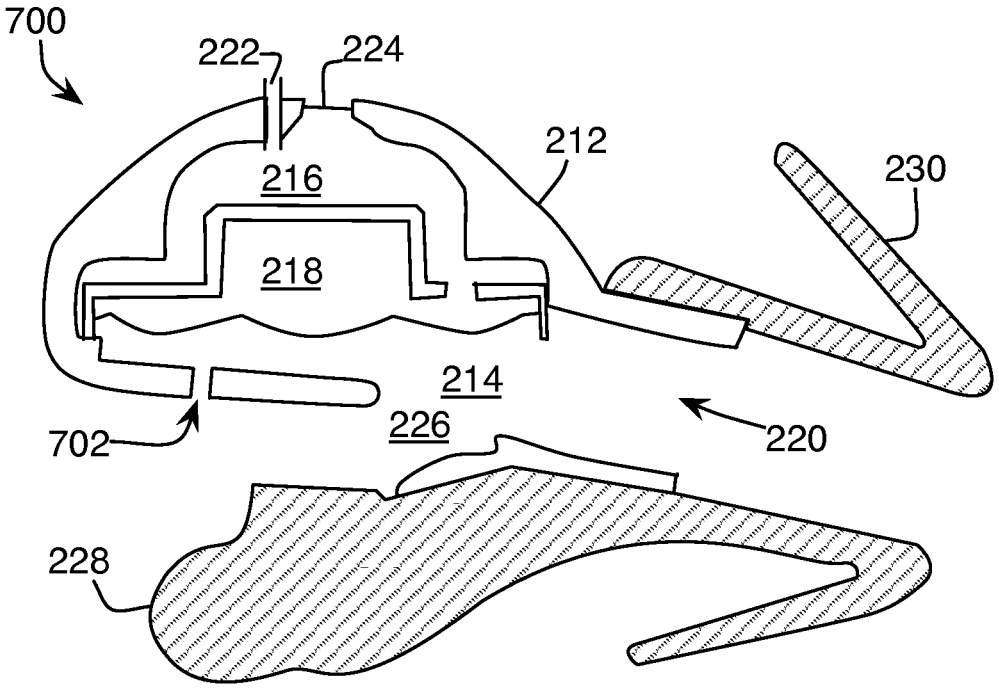
Figure 11:
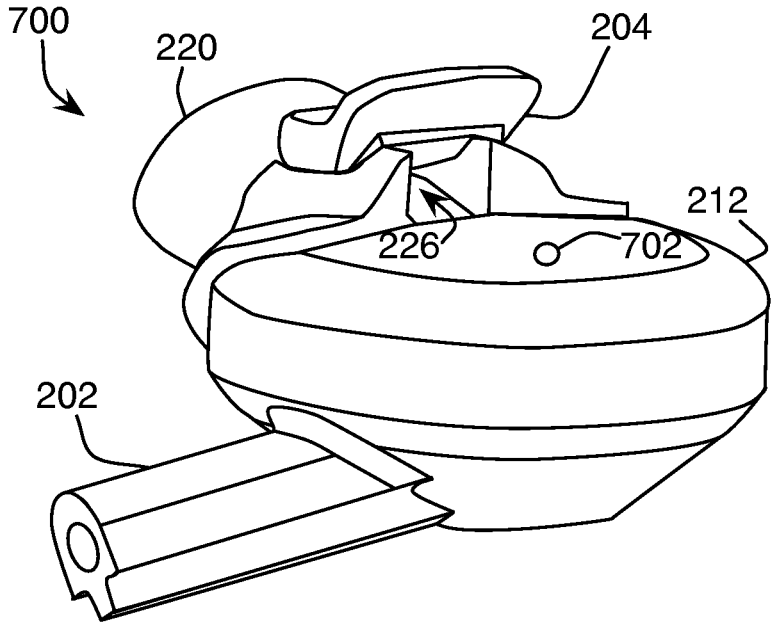

In some examples, it is advantageous to add a second PEQ port to further shape the passive frequency response of the headphone. As shown in the modified earbud 700 in FIGS. 10 and 11, an additional port 702 is added to the front cavity. This port 702 is shown as a small hole, but it could also be covered by a screen like port 224. While the reactive port 226 has an overall low impedance, an additional feature of the small PEQ port used previously, damping high-frequency peaks, is lost. Adding a low-reactance, high-impedance PEQ port in parallel to the high-reactance, low-impedance PEQ port 226 damps such peaks without impacting the low frequency response that was optimized by the large port. A characteristic impedance of $2.0\times10^7$ kg/m$^4$ or more at 3 kHz will provide such an advantage. For example, a 4 mm diameter hole covered by a mesh having an impedance of 260 Rayl will provide such an impedance.

A number of implementations have been described. Nevertheless, it will be understood that additional modifications may be made without departing from the scope of the inventive concepts described herein, and, accordingly, other embodiments are within the scope of the following claims.

What is claimed is:

1. A headphone comprising:

a housing defining an enclosed volume;

an electro-acoustic transducer dividing the enclosed volume into a front volume and a rear volume;

a first port in the housing arranged to couple the front volume to an ear canal of a user when the headphone is worn;

a second port in the housing arranged to couple the front volume to space outside the ear of the user when the headphone is worn;

a third port in the housing arranged to couple the rear volume to space outside the ear of the user when the headphone is worn; and an ear tip configured to surround the first port and including a flap to seal the ear canal from space outside the ear when the headphone is worn, the housing comprising an extended tab for retaining the ear tip;

wherein the second port has a diameter and a length that provide an acoustic mass with an acoustic impedance with a high reactive component and a low resistive component, and an entrance to the first port is positioned next to a first side of the extended tab and an entrance to the second port is positioned next to a second side of the extended tab, such that the electro-acoustic transducer is approximately symmetrically loaded.

2. The headphone of claim 1, wherein the second port has a diameter and a length that provide the second port with a low acoustic impedance at low frequencies and a high acoustic impedance at high frequencies.

3. The headphone of claim 1, wherein the ear tip includes a void positioned to surround the second port exit, the ear tip protecting the second port exit from blockage.

4. The headphone of claim 3, wherein the void does not impart additional acoustic impedance to the second port.

5. The headphone of claim 3, wherein the ear tip is formed from materials having at least two different hardnesses, the portion of the ear tip defining the void being of a greater hardness than the portion of the ear tip forming the seal.

6. The headphone of claim 1, wherein:

the transducer includes a diaphragm that is generally characterized by a first plane, is radially symmetric along a first axis perpendicular to the plane, and is bounded by an outer edge;

the first port extends from an entrance into the front volume near the outer edge of the transducer; and the second port extends from an entrance into the front volume, the second port entrance being located along a line connecting the first axis to the first port entrance.

7. The headphone of claim 6, wherein the second port entrance is located facing the diaphragm, between the first port and the first axis.

8. The headphone of claim 1, wherein the first port has a lower characteristic acoustic impedance than the second port.

9. The headphone of claim 8, wherein the second port has a characteristic acoustic impedance of at least $6.8\times10^6$ kg/m$^4$ at 20 Hz and at least $3.1\times10^7$ kg/m$^4$ at 3 kHz.

10. The headphone of claim 9, wherein the third port has a characteristic acoustic impedance of at least $8.0\times10^6$ kg/m$^4$ at 20 Hz and at least $3.1\times10^8$ kg/m$^4$ at 3 kHz.

11. The headphone of claim 1, wherein the second port has a characteristic acoustic impedance of at least $6.8\times10^6$ kg/m$^4$ at 20 Hz and at least $3.1\times10^7$ kg/m$^4$ at 3 kHz.

12. The headphone of claim 1, further comprising a fourth port in the housing arranged to couple the front volume to space outside the ear of a user when the headphone is worn, the fourth port has a diameter and a length that provide the fourth port with a high acoustic impedance with a large resistive component and a low reactive component.

13. The headphone of claim 12, wherein the fourth port has a characteristic acoustic impedance of at least $2.0\times10^7$ kg/m$^4$ at 3 kHz.

14. A headphone comprising:

a housing defining an enclosed volume;

an electro-acoustic transducer dividing the enclosed volume into a front volume and a rear volume;

a first port in the housing arranged to couple the front volume to an ear canal of a user when the headphone is worn;

a second port in the housing arranged to couple the front volume to space outside the ear of the user with a characteristic acoustic impedance of at least $6.8\times10^6$ kg/m$^4$ at 20 Hz and at least $3.1\times10^7$ kg/m$^4$ at 3 kHz when the headphone is worn;

a third port in the housing arranged to couple the rear volume to space outside the ear of the user with a characteristic acoustic impedance of at least $8.0\times10^6$ kg/m$^4$ at 20 Hz and at least $3.1\times10^8$ kg/m$^4$ at 3 kHz when the headphone is worn; and an ear tip configured to surround the first port and form a seal between the housing and the ear canal when the headphone is worn, wherein:

the housing comprises an extended tab for retaining the ear tip, and an entrance to the first port is positioned next to a first side of the extended tab and an entrance to the second port is positioned next to a second side of the extended tab, such that the electro-acoustic transducer is approximately symmetrically loaded.

15. The headphone of claim 14, wherein the ear tip includes a void positioned to surround the second port exit, the ear tip protecting the second port exit from blockage.

16. The headphone of claim 15, wherein the void does not impart additional acoustic impedance to the second port.

17. The headphone of claim 15, wherein the ear tip is formed from materials having at least two different hardnesses, the portion of the ear tip defining the void being of a greater hardness than the portion of the ear tip forming the seal.

18. The headphone of claim 14, wherein:

the transducer includes a diaphragm that is generally characterized by a first plane, is radially symmetric along a first axis perpendicular to the plane, and is bounded by an outer edge;

the first port extends from an entrance into the front volume near the outer edge of the transducer; and the second port extends from an entrance into the front volume, the second port entrance being located along a line connecting the first axis to the first port entrance.

19. The headphone of claim 18, wherein the second port entrance is located facing the diaphragm, between the first port and the first axis.

20. A headphone comprising:

an ear tip configured to seal the headphone to an ear canal of a user to form an enclosed volume including the ear canal and a front cavity of the headphone, a housing comprising an extended tab for retaining the ear tip, a front reactive port coupling the otherwise-sealed front cavity to space outside the headphone, to provide a consistent response across the audible spectrum, wherein the extended tab and ear tip cooperate to form a channel that surrounds the front reactive port, the channel protecting the front reactive port from blockage when the headphone is worn in the user's ear, and a rear reactive port and a rear resistive port coupling a back cavity to space outside the headphone in parallel, to provide a high level of output for a given input signal level in combination with the seal.

21. The headphone of claim 20, wherein the headphone is coupled to the ear canal through a characteristic acoustic impedance of less than $6.8\times10^6$ kg/m$^4$ at 20 Hz and less than $3.1\times10^7$ kg/m$^4$ at 3 kHz.

22. The headphone of claim 20, wherein the front reactive port has a characteristic acoustic impedance of at least $6.8\times10^6$ kg/m$^4$ at 20 Hz and at least $3.1\times10^7$ kg/m$^4$ at 3 kHz.

23. The headphone of claim 20, wherein the rear reactive port has a characteristic acoustic impedance of at least $8.0\times10^6$ kg/m$^4$ at 20 Hz and at least $3.1\times10^8$ kg/m$^4$ at 3 kHz.

24. The headphone of claim 20, further comprising a front resistive port coupling the front cavity to space outside the headphone in parallel to the front reactive port, the front resistive port having a characteristic acoustic impedance of at least $2.0\times10^7$ kg/m$^4$ at 3 kHz.

25. A headphone comprising:

an ear tip configured to seal the headphone to an ear canal of a user to form an enclosed volume including the ear canal and a front cavity of the headphone, a housing comprising an extended tab for retaining the ear tip, and a front reactive port and a front resistive port coupling the otherwise-sealed front cavity to space outside the headphone in parallel, to provide a consistent response across the audible spectrum, wherein the extended tab and ear tip cooperate to form a channel that surrounds the front reactive port, the channel protecting the front reactive port from blockage when the headphone is worn in the user's ear.

* * * * *